US008118974B2

(12) United States Patent
Nakai et al.

(10) Patent No.: US 8,118,974 B2
(45) Date of Patent: Feb. 21, 2012

(54) STRUCTURE FOR PRODUCING CASTINGS

(75) Inventors: Shigeo Nakai, Aichi (JP); Tokuo Tsuura, Tochigi (JP); Yoshimasa Takagi, Tochigi (JP); Tadashi Kusube, Tokyo (JP); Akira Yoshida, Aichi (JP); Yoshiaki Ban, Aichi (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 11/628,802

(22) PCT Filed: Jun. 10, 2004

(86) PCT No.: PCT/JP2004/008474

§ 371 (c)(1),
(2), (4) Date: Dec. 7, 2006

(87) PCT Pub. No.: WO2005/120745

PCT Pub. Date: Dec. 22, 2005

(65) Prior Publication Data

US 2008/0105401 A1 May 8, 2008

(51) Int. Cl.

| | |
|---|---|
| ***D21F 11/00*** | (2006.01) |
| ***D21F 13/00*** | (2006.01) |
| ***D21H 11/00*** | (2006.01) |
| ***D21H 13/00*** | (2006.01) |
| ***D21H 15/00*** | (2006.01) |
| ***D21H 17/00*** | (2006.01) |
| ***D21H 19/00*** | (2006.01) |
| ***D21H 21/00*** | (2006.01) |
| ***D21H 23/00*** | (2006.01) |
| ***D21H 25/00*** | (2006.01) |
| ***D21H 27/00*** | (2006.01) |
| ***D21J 1/00*** | (2006.01) |
| ***D21J 3/00*** | (2006.01) |
| *B22D 19/00* | (2006.01) |

(52) U.S. Cl. ..... 162/141; 162/146; 162/164.3; 162/165; 162/164.1; 162/181.1; 162/223; 164/9

(58) Field of Classification Search ..... 164/9; 162/141, 162/146, 164.1, 164.3, 165, 181.1, 223
See application file for complete search history.

(56) References Cited

U.S. PATENT DOCUMENTS

| | | | | |
|---|---|---|---|---|
| 4,285,901 | A * | 8/1981 | Yotsutsuji et al. | 264/225 |
| 4,339,115 | A * | 7/1982 | Daussan et al. | 266/280 |
| 4,440,864 | A | 4/1984 | Campbell et al. | |
| 4,550,127 | A * | 10/1985 | Renker | 523/212 |
| 5,632,326 | A * | 5/1997 | Gough | 164/529 |
| 5,942,168 | A * | 8/1999 | Ichikawa et al. | 264/40.1 |

(Continued)

FOREIGN PATENT DOCUMENTS

DE 4203904 C1 * 4/1993

(Continued)

OTHER PUBLICATIONS

Machine Translation of DE 4203904 C1, 2010.*

*Primary Examiner* — Liam Heincer
(74) *Attorney, Agent, or Firm* — Birch, Stewart, Kolasch & Birch, LLP

(57) ABSTRACT

The invention relates to a structure for producing castings, which comprises an organic fiber, carbon fiber, inorganic particles, and at least one kind of thermosetting resin selected from the group consisting of phenol resin, epoxy resin and furan resin.

10 Claims, 1 Drawing Sheet

U.S. PATENT DOCUMENTS

| | | | | |
|---|---|---|---|---|
| 2003/0062146 | A1 * | 4/2003 | Strezov | 164/480 |
| 2004/0069429 | A1 | 4/2004 | Tsuura et al. | |
| 2006/0130987 | A1 | 6/2006 | Tsuura et al. | |

FOREIGN PATENT DOCUMENTS

| | | | |
|---|---|---|---|
| EP | 0 062 193 | A1 | 10/1982 |
| EP | 1 488 871 | A1 | 12/2004 |
| EP | 1 577 034 | A1 | 9/2005 |
| FR | 2246516 | A | 5/1975 |
| GB | 1480898 | | 7/1977 |
| JP | 50-77415 | A | 6/1975 |
| JP | 53-48026 | | 5/1978 |
| JP | 53-48026 | A | 5/1978 |
| JP | 57-177846 | A | 11/1982 |
| JP | 4-147742 | A | 5/1992 |
| JP | 6-86843 | U | 12/1994 |
| JP | 8-192244 | A | 7/1996 |
| JP | 9-253792 | A | 9/1997 |
| JP | 10-5931 | A | 1/1998 |
| JP | 2003-230940 | A | 8/2003 |
| JP | 2004-174605 | A | 6/2004 |
| JP | 2004-181472 | A | 7/2004 |
| JP | 2004-195547 | A | 7/2004 |
| WO | WO 03076104 | A1 * | 9/2003 |
| WO | WO2004/043627 | A1 * | 5/2004 |

* cited by examiner

STRUCTURE FOR PRODUCING CASTINGS

FIELD OF THE INVENTION

The present invention relates to a structure such as a casting mold used in producing castings, a method of producing the structure, and a method of producing castings by the structure.

BACKGROUND OF THE INVENTION

Castings are produced generally by forming molding sand into a casting mold having a cavity in it, with a wooden pattern or a die, and, having arranged a core if necessary in the cavity, casting molten metal to the cavity.

Production of wooden pattern and dies requires skills in manufacturing and needs expensive facilities, and there arises the problem of disposal together with disadvantages such as high price and heavy weight, and their use is difficult except for mass-produced castings. The shape of a sand mold using molding sand is retained by adding a binder to usual sand and hardening it, and thus a regeneration process is essential for reutilizing the sand. In the regeneration process, there arises a problem such as generation of waste material such as dust. When a core is produced with sand casting, there is not only the problem described above but also difficulty in handling because of the weight of the core itself, and contradictory performance, that is, strength retention during casting and removability of the core after casting, is required.

For techniques of solving such problems, it is known that members used in casting molds are formed from, for example, organic-fiber products such as paper (see JP-A (U)6-86843), from inorganic fibers as a major component to which resin is added as a binder (see JP-A 10-5931), or from cellulose fibers to which inorganic powder or inorganic fibers are added (see JP-A 9-253792). A composition for forming a molding core comprising a refractory inorganic granular matter, inorganic and organic fibrous substances and a binder matter is also known (see JP-A 2003-230940).

SUMMARY OF THE INVENTION

The present invention provides a structure for producing castings, which comprises an organic fiber, an inorganic fiber, inorganic particles and a thermosetting resin, wherein the inorganic fiber is carbon fiber and the thermosetting resin is at least one thermosetting resin selected from phenol resin, epoxy resin and furan resin.

The present invention also provides a method of producing the invented structure for producing castings, which comprises a papermaking step with use of a starting slurry containing at least the organic fiber, the inorganic fiber and the inorganic particles.

The present invention relates to use of the structure described above as a core for producing castings.

DETAILED EXPLANATION OF THE INVENTION

The prior literatures mentioned above have a certain effect for the problems of weight saving, workability and waste material, but suffer from problems: 1) difficulty in obtaining a uniform formed mold and poor moldability particularly into a uniform hollow structure, 2) insufficient shape retention, after casting, of a casting due to low hot strength, and 3) low surface smoothness of the resulting casting.

The present invention was made in view of the problems described above, and the present invention provides a structure for producing castings, which is lightweight and excellent in moldability, has a sufficient hot strength and shape retention even upon casting to give a casting excellent in shape retention and surface smoothness, and is excellent in removability after casting, a method of producing the same, and a method of producing castings by using the same.

The present inventors found that a structure for producing castings, which comprises inorganic particles in addition to an organic fiber, carbon fiber and specific thermosetting resin can achieve the object described above.

The structure for producing castings according to the present invention is a refractory article used in production of castings, and specific examples include casting molds and members around casting molds.

The present invention provides a method of producing castings by using the invented structure of producing castings, thereby achieving the object described above.

The present invention is described in detail by reference to its preferable embodiment.

The structure for producing castings in this embodiment comprises an organic fiber, carbon fiber, inorganic particles and specific thermosetting resin. The organic fiber, the carbon fiber, the inorganic particles and the thermosetting resin are compounded such that the organic fiber/carbon fiber/inorganic particle/thermosetting resin ratio is preferably 10 to 70/1 to 70/10 to 70/5 to 70 (ratio by weight), more preferably 10 to 50/2 to 50/20 to 60/5 to 50 (ratio by weight), even more preferably 10 to 30/2 to 30/30 to 60/5 to 40 (ratio by weight).

The content of the organic fiber in the structure for producing castings is preferably 10 wt % or more, from the viewpoint of sufficiently exhibiting the effect of the organic fiber added and from the viewpoint of the excellent moldability of the structure and the excellent removability of the structure after casting, or the content of the organic fiber is preferably 70 wt % or less, more preferably 50 wt % or less, even more preferably 30 wt % or less, from the viewpoint of reducing the amount of gas generated upon casting thereby inhibiting generation of surface defects of a casting and from the viewpoint of the heat resistance of the structure and the shape retention of a casting. From the foregoing, the proportion of the organic fiber in the structure for producing castings is preferably 10 to 70 wt %, more preferably 10 to 50 wt %, further more preferably 10 to 30 wt %.

The content of the carbon fiber in the structure for producing castings is preferably 1 wt % or more, more preferably 2 wt % or more, from the viewpoint of suppressing thermal shrinkage accompanying a reduction in the heat resistance of the structure thereby improving the shape retention of a casting, or is preferably 70 wt % or less, more preferably 50 wt % or less, even more preferably 30 wt % or less, from the viewpoint of the excellent moldability of the structure and the excellent removability of the structure after casting. From the foregoing, the proportion of the carbon fiber in the structure for producing castings is preferably 1 to 70 wt %, more preferably 2 to 50 wt %, even more preferably 2 to 30 wt %.

The content of the inorganic particles in the structure for producing castings is preferably 10 wt % or more, more preferably 20 wt % or more, even more preferably 30 wt % or more, from the viewpoint of sufficiently exhibiting the effect of the added inorganic particles as described later. The content of the inorganic particles is preferably 70 wt % or less, more preferably 60 wt % or less, from the viewpoint of the excellent moldability of the structure and the excellent shape retention of a casting. From the foregoing, the proportion of the inorganic particles in the structure for producing castings is preferably 10 to 70 wt %, more preferably 20 to 60 wt %, even more preferably 30 to 60 wt %.

The content of the thermosetting resin in the structure for producing castings is preferably 5 wt % or more, from the viewpoint of attaining the surface smoothness of a casting and from the viewpoint of improving the strength and shape retention of the structure, or is preferably 70 wt % or less, more preferably 50 wt % or less, even more preferably 40 wt % or less, from the viewpoint of improving the moldability of the structure and from the viewpoint of reducing the amount of gas generated thereby suppressing surface defects of a casting. From the foregoing, the proportion of the thermosetting resin in the structure for producing castings is preferably 5 to 70 wt %, more preferably 5 to 50 wt %, even more preferably 5 to 40 wt %.

The present invention is characterized by using carbon fiber in combination with specific thermosetting resin, and by this combination, the hot strength and shape retention of the structure for producing castings can be improved to produce castings excellent in surface smoothness with high molding accuracy. The reason that the effect of the invention is exhibited is not evident but is estimated attributable to formation of a certain structure of the carbon fiber and the specific thermosetting resin. Particularly, the thermosetting resin having a high actual carbon ratio as described later is considered to exhibit this function highly, thus exhibiting a more significant effect.

The organic fiber is mainly a component which prior to use in casting, constitutes the skeleton of the structure for producing castings, to improve the moldability of the structure for producing castings. The organic fiber is also a component which upon casting, burns partially or wholly by the heat of molten metal, to form voids in the structure for producing castings so that the removability of the structure for producing castings can be improved after production of castings.

The organic fibers include fibers such as paper fibers, fibrillated synthetic fibers, and regenerated fibers (for example, rayon fiber). The organic fibers can be selected from these fibers and used alone or as a mixture of two or more thereof. Among these fibers, paper fibers are preferably used from the viewpoint of not only moldability in various shapes by papermaking but also sufficient strength after dehydration and drying.

The paper fibers include wood pulp, cotton pulp, linter pulp, bamboo, straw, and other non-wood pulp. The paper fibers can be selected from such virgin pulp and recycled pulp and used alone or as a mixture of two or more thereof. The paper fibers are particularly recycled pulp from the viewpoint of easy availability, environmental production, reduction in manufacturing costs, etc.

The average fiber length of the organic fibers is preferably 0.3 to 2.0 mm, more preferably 0.5 to 1.5 mm, in consideration of the moldability, surface smoothness and impact resistance of the structure for producing castings.

The carbon fiber is mainly a component which prior to use in casting, constitutes the skeleton of the structure for producing castings, and upon casting, maintains the shape of the structure without combustion by the heat of molten metal. The carbon fiber is particularly a component which prevents the structure for producing castings from being thermally shrunk by the heat of molten metal.

The carbon fiber used is preferably pitch- or polyacrylonitrile (PAN)-based carbon fiber having high strength even at high temperatures, particularly preferably PAN-based carbon fiber, by which shrinkage accompanying the thermal decomposition of the structure for producing castings can be effectively prevented. The carbon fiber can be used in combination with inorganic fibers such as artificial mineral fibers (e.g. rock wool), ceramic fibers and natural mineral fibers.

The average length of the carbon fiber is preferably 0.2 to 10 mm, more preferably 0.5 to 8 mm, from the viewpoint of dehydration of the structure for producing castings after papermaking and the moldability and uniformity of the structure for producing castings.

The carbon fiber has a function of effectively preventing the structure for producing castings from undergoing thermal shrinkage accompanying thermal decomposition.

The inorganic particles include inorganic particles having a refractoriness of 800 to 4000° C., preferably 1000 to 4000° C., such as silica, alumina, mullite, magnesia, zirconia, mica, graphite and obsidian, among which graphite is preferable for thermal resistance and removability after molding of the structure. These inorganic particles may be used alone or in combination with two or thereof.

The inorganic particles used are preferably those having a refractoriness of 800 to 2000° C., so that when a casting is produced from molten metal having a carbon equivalent of 4.2% or less, particularly 4.0% or less, a carbide film contained in the structure or formed by thermal decomposition by the heat of the molten metal can be prevented from being dissolved in the molten metal of low carbon equivalent, or when molding sand is arranged in the outside of the structure or in the inside of a hollow core, the surface smoothness of a casting obtained by preventing the adhesion of the sand to the surface of the casting can be further improved. When a casting is produced from molten metal having a carbon equivalent of 4.2% or less, obsidian is preferably used in cast iron, and mullite powder is preferably used in cast steel and stainless steel, from the viewpoint of high viscosity upon softening and particularly high effect of preventing a carbon film from being dissolved in molten metal.

Particularly, obsidian, and mineral particles other than obsidian (hereinafter, referred to as mineral particles), can be simultaneously used in the present invention to form a structure by which a casting having significantly improved dimensional accuracy can be produced. The mineral particles are preferably those having a refractoriness of 1200° C. or more, and examples thereof include silica (refractoriness of for example 1650° C. or more), alumina (refractoriness of for example 1700° C. or more), mullite (refractoriness of for example 1650° C. or more), magnesia (refractoriness of for example 2500° C.), zircon (refractoriness of for example 2000° C. or more), chromite (refractoriness of for example 1950° C. or more), graphite (refractoriness of for example 3300° C. or more) etc. These may be used alone or in combination with two or more thereof. Combined use of obsidian and the mineral particles is more preferable for producing castings from molten metal having a carbon equivalent of 4.2% or less, particularly 4.0% or less. According to the present invention, there can be provided a structure for producing castings from molten metal having a carbon equivalent of 4.2% or less, which comprises an organic fiber, carbon fiber, inorganic particles consisting of a combination of obsidian and mineral particles other than obsidian, and thermostatic resin.

When obsidian and the mineral particles described above are simultaneously used, the compounding ratio of (1) obsidian to (2) mineral particles other than obsidian, that is, the (1)/(2) ratio by weight is preferably 10/90 to 90/10, more preferably 25/75 to 75/25.

The refractoriness of the inorganic particles is measured by a measurement method using a Seger cone (JISR2204). The refractoriness of general obsidian is 1200 to 1250° C.

The inorganic particles used are preferably those having an average particle diameter of 200 μm or less. Obsidian and the mineral particles described above, when simultaneously used, are preferably those having an average particle diameter of 200 μm or less respectively. The inorganic particles are particularly preferably those having a refractoriness of ±300° C., particularly ±200° C., relative to the casting temperature of molten metal to be cast.

The average particle diameter of the inorganic particles is the average particle diameter of 50% volume accumulation measured by a laser diffraction particle size distribution measuring device (LA-920 manufactured by Horiba, Ltd.). The analysis conditions are as follows:

Measurement method: flow method

Refractive index: changed depending on inorganic particles (see a manual attached to LA-920).

Disperse medium: deionized water+0.1% sodium hexametaphosphate

Dispersion method: stirring, built-in supersonic wave for 3 minutes

Sample concentration: 2 mg/100 cc

A casting material having a carbon equivalent of 4.2% or less includes cast iron, cast steel, stainless steel etc. having not lower than the strength of casting material FC-300. The carbon equivalent is given by [C (%)+Si (%)/3] for cast iron and [C+(1/6) Mn+(1/24) Si+(1/40) Ni+(1/5) Cr+(1/4) Mo+(1/14) V] % for cast steel, and the cast equivalent of general casting material is described in, for example, "Chuzo Kogaku" (Foundry Engineering) authored by Hideo Nakae, p. 20, Sangyo Tosho, 1995.

The thermosetting resin includes thermosetting resin such as phenol resin, epoxy resin and furan resin. The thermosetting resin is a component necessary for maintaining strength at ordinary temperatures and hot strength and for improving the surface roughness of a casting, and can endow the product with the same surface roughness as attained by a sand mold coated with a coating lubricant. No coating lubricant may be used. This is an important property for the invented casting-producing structure containing an organic fibers etc., which are difficult in igniting and drying with a conventional alcohol-based coating lubricant or the like.

The thermosetting resin having such performance is preferably phenol resin because it has an inhibitory effect on combustion with lower generation of combustible gas therefrom, has an actual carbon ratio as high as 25% or more after thermal decomposition (carburization), and can form a carbon film upon casting to give an excellent casting surface. The actual carbon ratio can be determined from the weight of residues after heating at 1000° C. in a reduction atmosphere (in a nitrogen atmosphere) by differential thermal analysis. The phenol resin includes phenol resins such as novolak phenol resin, resol phenol resin, a phenol resin of bisphenol A or bisphenol F and modified phenol resins modified with urea, melamine, epoxy or etc. It includes preferably novolak phenol resin, resol phenol resin, resol resin of bisphenol A or modified resins thereof. When the novorak phenol resin mentioned above is used as the thermosetting resin, a hardener necessary in the phenol resin is easily dissolved in water, so when a wet papermaking process is used, the formed product after dehydration is preferably coated with the hardener. The hardener is preferably hexamethylene tetramine or the like.

The epoxy resin includes bisphenol A type epoxy resin, novolak type epoxy resin, alicyclic epoxy resin, etc., preferably phenol or o-cresol novolak type epoxy resin. The hardener for the epoxy resin includes amines, acid anhydrides, phenol novolak etc., preferably phenol novolak. A curing catalyst such as triphenyl phosphine can be used if necessary.

The furan resin includes resin based on furfuryl alcohol and may be modified with formaldehyde, urea etc. The hardener used for the furan resin includes acidic compounds such as xylenesulfonic acid, sulfuric acid and phosphoric acid.

The thermosetting resins can be selected from those described above, can be used alone or as a mixture of two or more thereof or can be used in combination with acrylate resin, polyvinyl alcohol resin etc. Particularly, when the structure for producing castings according to the present invention is applied to a hollow core, the thermosetting resin (particularly having an actual carbon ratio of 15% or more, especially 25% or more) can be used to attain hot strength to function sufficiently for the hollow core.

The thermosetting resin may be contained in any forms insofar as it can be carburized later by the heat of molten metal to form a carbon film capable of contributing to maintenance of the strength of the structure for producing castings and to improvement of the surface smoothness of castings; for example, the thermosetting resin can be applied onto the organic fiber, the carbon fiber or the inorganic articles or powdered or emulsified and added to the starting slurry, or bound to the organic fiber, the carbon fiber and the inorganic particles upon drying and molding after papermaking, or a molded product produced after papermaking can be impregnated with the thermosetting resin and dried or cured thereby increasing the strength of the resulting structure for producing castings.

In addition to the organic fiber, the carbon fiber, the inorganic particles and the thermosetting resin, paper durability-reinforcing materials such as polyvinyl alcohol, carboxymethyl cellulose (CMC) and polyamide amine epichlorohydrin resin, flocculating agents such as polyacrylamide-based flocculating agents, and other components such as coloring matters can be added in a suitable proportion to the structure for producing castings in this embodiment.

The surface roughness (Ra) of the structure for producing castings according to this embodiment is preferably 20 μm or less, more preferably 3 to 15 μm, even more preferably 5 to 10 μm or less. With such surface roughness given, the resulting casting can be made more excellent in surface smoothness. The surface roughness can be measured with a commercial measuring instrument described later in the Examples.

Although the thickness of the structure for producing castings according to this embodiment can be established depending on the position, the thickness of the structure in contact with at least molten metal is preferably 0.2 to 5 mm, more preferably 0.4 to 2 mm. A thickness of 0.2 mm or more is preferable because a sufficient strength required for filling of molding sand and hardening can be attained, and the shaping function of the structure for producing castings, particularly the structure such as a core, can be maintained. A thickness of 5 mm or less is preferable because the amount of gas generated upon casting can be reduced to bring about less generation of surface defects of a casting, the molding time can be shortened, and the manufacturing costs can be reduced.

The transverse strength of the structure for producing castings in this embodiment is preferably 5 MPa or more, more preferably 10 MPa or more, prior to use in casting.

When the structure for producing castings in this embodiment is produced via a papermaking step of using the starting slurry with water as a disperse medium, the water content (water content by weight) in the structure prior to use in casting is preferably 10% or less, more preferably 8% or less, from the viewpoint of minimizing the amount of gas generated upon casting.

From the viewpoint of weight saving and easiness in molding operation and secondary fabrication, the specific gravity of the structure for producing castings in this embodiment is preferably 1.0 or less, more preferably 0.8 or less, prior to use in casting.

The structure for producing castings in this embodiment can be applied to a main mold having a cavity for shaping a casting in it, a core used in the main mold, or a casting member such as a sprue runner, and the structure for producing castings according to the present invention is excellent in surface smoothness, can thus give a casting having a favorable casting surface, and is therefore applied preferably to the main mold or the core. Particularly, the structure is excellent in hot compressive strength, has high shape retention and is also excellent in removability after casting, and is thus applied to a core, particularly a hollow core having high retention even in a hollow form to make filling of molding sand unnecessary.

When the structure for producing castings in this embodiment is used in production of castings, the curing, with a binder, of molding sand filled around the main mold or of molding sand filled for the purpose of backup in the hollow core is not always necessary unlike the prior art, which also brings about an advantage of facilitating the regeneration of molding sand.

The method of producing a structure for producing castings according to the present invention is described in detail by reference to a method of producing the invented structure for producing castings which has been described in the above preferable embodiment.

In the production method in this embodiment, starting slurry containing the organic fiber, the organic carbon fiber, the inorganic particles and the thermosetting resin in the above predetermined compounding ratio is prepared, and the starting slurry is used in a wet papermaking process to make a fiber layer in a predetermined shape, then dehydrated and dried to produce the structure for producing castings.

A disperse medium for the starting slurry includes not only water and white water, but also solvents such as ethanol and methanol, among which water is particularly preferable from the viewpoint of stability in papermaking and dehydration, stability of qualities, costs, and easiness in handling, etc.

In the starting slurry, the ratio of the respective fibers and inorganic particles in total to the disperse medium is preferably 0.1 to 3 wt %, more preferably 0.5 to 2 wt %. When the content of the fibers and particles in total in the starting slurry is too high, uneven wall thickness easily occur. In the case of a hollow article, the inner surface may be deteriorated. When the content of the fibers and particles in total is too low, on the other hand, thin wall parts may be topically generated.

If necessary, additives such as the above-mentioned paper durability-reinforcing materials, the above-mentioned flocculating agents, and preservatives can be added in an appropriate ratio to the starting slurry.

The papermaking process of the fiber layer makes use of a die consisting of, for example, a pair of split molds allowed to butt against each other to form a cavity therein that opens to the outside and has a shape corresponding approximately to the outer shape of the structure for producing castings. Each split mold is provided with a large number of communicating openings through which the cavity communicates with the outside, wherein each split mold is covered therein with a net having a predetermined mesh size. A predetermined amount of the starting slurry is injected by a pressure pup into the cavity in the die and simultaneously the liquid portion of the slurry is discharged by suction through the communicating openings thereby accumulating solids in the starting slurry on the net. The pressure in pressure-injection of the starting slurry is preferably 0.01 to 5 MPa, more preferably 0.01 to 3 MPa.

When a fiber layer of predetermined thickness is formed on the net by injection of a predetermined amount of the starting slurry, pressure-injection of the starting slurry is stopped, and air is pressed into the cavity thereby dehydrating the fiber layer to a predetermined water content.

Then, the fiber laminate is dried and molded. This step of drying/molding makes use of a dry form having a pair of split molds allowed to butt against each other to form a cavity that opens to the outside and has a shape corresponding approximately to the outer shape of the casting-producing structure to be formed. Then, the dry form is heated to a predetermined temperature, and the dehydrated fiber laminate is charged into the dry form. To obtain the casting-producing structure having the surface roughness described above, the surface roughness (Ra) of the molding surface of a cavity in the dry form is preferably 15 μm or less, more preferably 10 μm or less, even more preferably 3 μm or less.

Then, an elastic, retractile and hollow core (elastic core) is inserted into the cavity, and the core is supplied with pressurized fluid thereby expanding the core in the cavity. The fiber laminate is pressed against the molding surface of the cavity and dried while the inner shape of the cavity is transferred to the fiber laminate. The core used is a core made of e.g. urethane, fluorine-based rubber, silicone-based rubber or an elastomer.

The pressurized fluid to expand the core is for example compressed air (heated air), oil (heated oil), and other kinds of various fluids. The pressure in supplying the pressurized fluid is preferably 0.01 to 5 MPa, more preferably 0.1 to 3 MPa.

The heating temperature (die temperature) of the dry form is preferably 180 to 250° C., more preferably 200 to 240° C., in consideration of drying time and deterioration in surface nature by burnt deposits.

After the fiber laminate is dried, the pressurized fluid in the core is released to shrink the core, followed by removing the core from the fiber laminate. Then, the dry form is opened to remove the dried and molded structure for producing castings.

If necessary, the resulting structure for producing castings can be coated by impregnating it partially or wholly with colloidal silica, ethyl silicate, liquid glass etc. to improve strength.

The thus obtained structure for producing castings can be prevented from undergoing cracking etc. due to thermal shrinkage, can attain high hot strength and is excellent in surface smoothness because its components, that is, the organic fiber, carbon fiber, inorganic particles and thermosetting resin are uniformly dispersed therein.

The fiber laminate is molded with the core in it by pressing it against the molding surface of the cavity in the dry form, and thus the smoothness of its internal and external surfaces is high. Accordingly, when the fiber laminate is used in production of a casting, the resulting casting is made particularly excellent in smooth surface. The fiber laminate, even when formed in a hollow shape or in a complicated three-dimensional shape, does not necessitate a laminating step, and thus the finally obtained structure for producing castings does not have a thick-wall part or a joint line by lamination. owing to this aspect too, a casting of uniform wall thickness excellent in surface smoothness with high molding accuracy, high mechanical strength and high accuracy can be produced. Accordingly, the structure for producing castings can be applied naturally not only to the main mold and the core, but also to a structure such as a sprue runner having a fitting part and a screw part.

The structure for producing castings is subjected previously to heat treatment preferably at 150 to 300° C., more preferably at 150 to 250° C., to advance curing of the thermosetting resin. By carrying out such heat treatment, a casting-producing structure having more excellent shape retention can be obtained. Particularly, heat treatment is also preferable where there is concern that gas defects are generated depending on casting material and shape. The curing degree of the thermosetting resin by such heat treatment is made preferably 30% or more, more preferably 80% or more, in terms of the amount of the insoluble of the thermosetting resin in acetone.

Specifically, the amount of the insoluble of the thermosetting resin is determined as follows:

That is, about 5 g sample is collected from the structure for producing castings and then milled with a mill, and its weight (a) is precisely measured. Together with acetone, this milled sample is added to a container, sufficiently shaken and left at ordinary temperatures. Then, the milled sample was sufficiently filtered through a filter paper (weight (c)) such that the milled sample does not remain in the container, and the filtered milled sample together with the filter paper is dried, and the weight (b) thereof (that is, the weight of the milled sample and the filter paper) is accurately measured. On the basis of the determined weights (a) to (c) and the theoretical weight (d) of the components other than the thermosetting resin in the milled sample, the amount of the insoluble (%) of the thermosetting resin is determined according to the following equation:

$$\text{Amount of the insoluble (\%)}=100-(a-(b-c))\times 100/(a-d)$$

Now, the method of producing castings according to the present invention is described in detail by reference to its preferable embodiment.

In the production method in this embodiment, the given structure for producing castings obtained in the manner described above is laid in a predetermined position in molding sand. As the molding sand, usual molding sand used in production of a casting of this kind can be used without particular limitation. The binder may or may not be cured with a binder depending on the case. When the structure for producing castings is a hollow core, filling of molding sand into the core is unnecessary, or molding sand can be filled in the core. Molten metal is cast by pouring it through a pouring gate into the structure for producing castings. At this time, the hot strength of the structure for producing castings is maintained by the carbon fiber and thermosetting resin thereby preventing the structure from undergoing thermal shrinkage accompanying thermal decomposition, and thus the casting-producing structure scarcely undergoes cracking, and the casting-producing structure itself is scarcely broken, and therefore penetration of molten metal into the casting-producing structure or adhesion of molding sand to the structure is scarcely generated. Even when a casting is produced using molten metal having a carbon equivalent of 4.2% or less, the inorganic particles can be softened by the heat of the molten metal, thus isolating, from the molten metal, carbon formed by thermal decomposition of the casting-producing structure, thereby preventing the carbon from being dissolved in the molten metal of low carbon equivalent. Accordingly, the surface smoothness of the casting can be maintained, and the carbon equivalent of the resulting casting can be maintained stably in a predetermined range.

After casting is finished, the molten metal is cooled to a predetermined temperature, and the casting frame is dismantled to remove molding sand, and the casting-producing structure is removed by blasting to expose the casting. At this time, the organic fiber has been thermally decomposed, and thus the removal of the casting-producing structure is easy. Thereafter, the casting is subjected if necessary to post-treatment such as trimming etc. to complete production of the casting.

The method of producing a casting in this embodiment comprises using a casting-producing structure containing the organic fiber, the carbon fiber, the inorganic particles and the thermosetting resin, so by the carbon fiber and the thermosetting resin, the structure can maintain hot strength to produce a casting excellent in dimensional accuracy and surface smoothness. Even when molten metal having a carbon equivalent of 4.2% or less is used to produce a casting, carbides generated by thermal decomposition of the casting-producing structure can be prevented from being dissolved in the molten metal of low carbon equivalent. By thermal decomposition of the organic fiber etc., voids are formed in the casting structure to facilitate removal of the casting-producing structure after casting, thus making its disposal easier than conventional, and the amount of waste can be reduced significantly. Curing of molding sand with a binder is not necessary, thus making regeneration of the molding sand easy.

The invention is not limited to the embodiment described above, and can be suitably altered without departure from the gist of the invention.

The structure for producing castings according to the present invention, as described in the above embodiment, is preferably produced through the wet papermaking method to produce a molded product, followed by a dehydration step and a drying/molding step in order to form a three-dimensional hollow structure for producing castings, or alternatively the structure for producing castings can be produced by subjecting the starting slurry described above to papermaking to form a molded product in the form of a sheet and then rolling it as a paper core.

The structure for producing castings is produced such that after drying and molding, it finally has a shape corresponding to the shape of an intended casting, or otherwise the molded product after drying may be cut and divided into parts so that the divided parts are connected to one another by fitting or screwing them together to form the structure for producing castings. In this latter case, it is preferable that the ends or divided parts are previously formed in a form to have portions through which they can fit or screw to one another.

According to the present invention, the following effects are demonstrated:

1. The structure for producing castings according to the present invention is excellent in hot strength and shape retention even during casting. Therefore, the curing of molding sand with a binder is not necessary at the time of casting in the method of producing a casting with the structure of the invention. Accordingly, the regeneration of the sand by mechanical grinding after casting is unnecessary, thus making the amount of waste material lower than conventional. Particularly in use as a core in a hollow shape, the filling of molding sand into the core is unnecessary.
2. The structure for producing castings according to the present invention is excellent in removability after casting and can be easily removed more easily than conventional.
3. The lightweight of the structure for producing castings according to the present invention makes its handling easy.

4. In the method of producing the structure for producing castings according to the present invention, starting slurry containing organic fibers, carbon fiber that is an inorganic fiber, and inorganic particles is produced by papermaking, and thus the resulting structure for producing castings can have these components dispersed uniformly and evenly therein. Accordingly, generation of cracking etc. accompanying thermal shrinkage can be prevented, high hot strength can be obtained, and surface smoothness is excellent. Even in forming the structure in a hollow shape or in a complicated three-dimensional shape, a laminating step is unnecessary, and thus the finally obtained structure for producing castings has uniform wall thickness and has high molding accuracy and mechanical strength. Accordingly, a casting excellent in smooth surface can be produced highly accurately.

Figure 1:
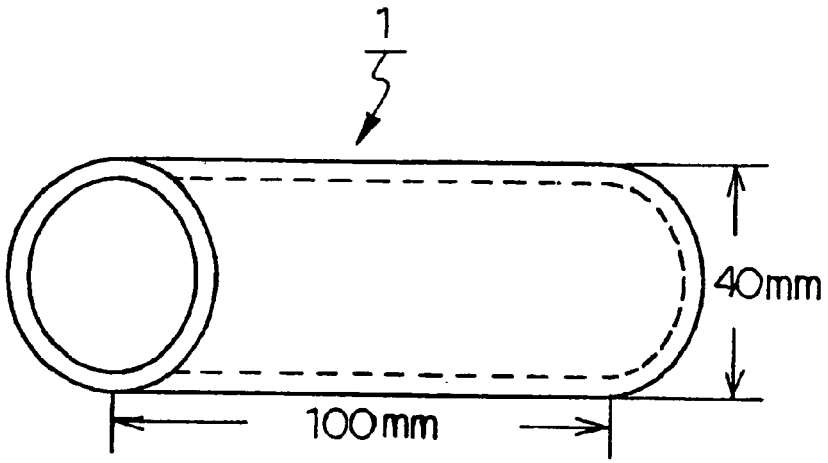
FIG. 1 is a perspective view schematically showing a casting produced by using one embodiment wherein the structure for producing castings according to the invention is applied to a hollow core.

Symbol 1 is a hollow core (structure) and 10 is a casting.

EXAMPLES

Hereinafter, the present invention is described in more detail by reference to the Examples.

Casting-producing structures having the compositions of materials shown in Table 1 were produced as shown in Examples 1 to 7 and Comparative Examples 1 to 3, and the resulting structures for producing castings were measured for their weight, surface roughness (Ra) and the amount of the insoluble of the thermosetting resin, and the moldability of the structures for producing castings was evaluated in the following manner. The resulting structures for producing castings were used to produce castings, and the shape retention of the castings (shape retention of the structures for producing castings), the surface smoothness of the castings, and the removability, after casting, of the structures for producing were evaluated in the following manner. The results are collectively shown in Table 1.

Example 1

<Preparation of Starting Slurry>

Organic fibers, carbon fibers and inorganic particles, each of which is shown below, were dispersed in water in a composition shown in Table 1 to prepare about 1 wt % slurry, and then thermosetting resin powder and a suitable amount of a flocculating agent shown below were added to the slurry to prepare starting slurry.

Organic fibers: Waste newspaper (average fiber length 1 mm, freeness (CSF) 150 cc)

Inorganic fibers: PAN-based carbon fiber (Toreka Chop, fiber length 3 mm, shrinkage degree 0.1%, manufactured by Toray)

Inorganic particles: Obsidian (Nice Catch, average particle diameter 30 μm, manufactured by KINSEI MATEC CO., LTD.)

Thermosetting resin: Novolak phenol resin (SP1006LS, actual carbon ratio 38%, manufactured by Asahi Organic Chemicals Industry Co., Ltd.)

Flocculating agent: Polyacrylamide-based flocculating agent (A110, manufactured by Mitsui Scitec)

<Papermaking of a Structure for Producing Castings>

A used papermaking mold was a pair of split molds having a cavity molding surface (surface roughness (Ra) 0.9 μm) corresponding to ϕ40×100 mm, wherein the cavity molding surface was provided with a net having a large number of communicating openings of predetermined size through which the cavity molding surface communicated with the outside. The above starting slurry was circulated by a pressure pump and a predetermined amount of the slurry was pressed into the papermaking mold, while the fluid portion of the slurry was discharged through the communicating openings, whereby a predetermined fiber laminate was accumulated on the surface of the net. After injection of a predetermined amount of the starting slurry was completed, the papermaking mold on which the fiber laminate had been accumulated was supplied with 0.2 MPa pressurized air for about 30 seconds, to dehydrate the fiber laminate. The whole surface of the resulting fiber laminate was coated uniformly with an aqueous dispersion of a hardener (hexamethylene tetramine) in an amount of 15% (weight ratio) relative to the thermosetting resin. Then, the fiber laminate was removed from the papermaking mold and transferred to a dry form heated at 220° C. The dry form used was a pair of split molds having a cavity molding surface corresponding to ϕ40×100 mm, provided with communicating openings through which the cavity molding surface communicated with the outside. In the drying step, a bag-shaped elastic core was inserted through an upper opening of the dry form, and the dry form was closed and then supplied with pressurized fluid (pressurized air, 0.2 MPa) thereby expanding the elastic core. Then, the fiber laminate was pressed against the inner face of the dry form thereby transferring the inner shape of the dry form to the fiber laminate and simultaneously drying the fiber laminate. After pressurization/drying for a predetermined time (180 seconds), the pressurized fluid in the elastic core was released to shrink the elastic core which was then removed from the dry form. The resulting molded product was removed from the dry form and cooled to give a hollow core 1 of 1.2 mm in thickness weighing about 7 g in the form shown in FIG. 1 with the composition shown in Table 1.

<Production of a Casting>

Figure 2:
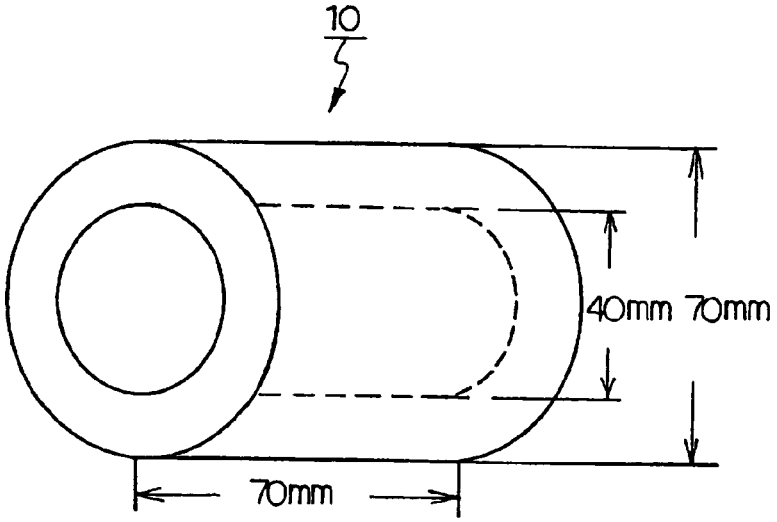
FIG. 2 is a perspective view schematically showing a casting produced by using the hollow core in the above embodiment.

A main mold having a cavity corresponding to casting 10 in a tubular form as shown in FIG. 2 was produced from molding sand, and the above hollow core 1 of ϕ40×100 mm was arranged therein, and without filling molding sand in the core 1, a casting with cast material FC-300 was produced at a casting temperature of 1380° C.

[Measurement of the Surface Roughness of the Structure for Producing Castings]

After drying and molding, the surface roughness of the structure for producing castings was measured with Surtronic 10 manufactured by Taylor Hobson Ltd.

[Measurement of the Amount of the Insoluble of the Resin of the Structure for Producing Castings]

The amount of the insoluble of the thermosetting resin of the structure for producing castings was measured according the measurement method described above under the following conditions:

Solvent: acetone (50 g)

Container: 100-cc screw tube

Shaking time: 10 minutes

Time for which the structure was left: 12 hours at ordinary temperature

Drying temperature: 60° C.

Drying time: 30 minutes

[Evaluation of the Moldability of the Structure for Producing Castings]

After drying and molding, the shape of the structure for producing castings was judged with the naked eye, and its moldability was evaluated under the following 3 ranks:

○: The shape of the dry form is transferred thereto with high dimensional accuracy.

Δ: The shape of the dry form is almost transferred thereto although dimensional accuracy is inferior.

x : The shape of the dry form is hardly transferred thereto.

[Evaluation of the Shape Retention of the Casting After Production]

The shape retention of the casting after production was evaluated with the naked eye and evaluated under the following 4 ranks:

⊙: The shape of the structure for producing castings is transferred thereto with very high dimensional accuracy.

○: The shape of the structure for producing castings is transferred thereto with high dimensional accuracy.

Δ: The shape of the structure for producing castings is almost transferred thereto although dimensional accuracy is inferior.

x : The shape of the structure for producing castings is hardly transferred thereto.

[Evaluation of the Smooth Surface of the Casting]

The surface roughness (Ra) of the part of the resulting casting which had been contacted with the structure for producing castings was measured and evaluated under the following 3 ranks. The surface roughness of the casting was measured with Surtronic 10 manufactured by Taylor Hobson Ltd.

○: 15 μm or less

Δ: higher than 15 to less than 50 μm x : 50 μm or more

[Evaluation of the Removability, After Casting, of the Structure for Producing Castings]

After casting, the removability of the structure for producing castings was evaluated under the following 3 ranks:

○: Easily removable.

Δ: Slightly hardly removed.

x : Hardly removed.

Example 2

A hollow core of 1.2 mm in thickness weighing 7 g was obtained in the same manner as in Example 1 except that synthetic mullite MM (average particle diameter 30 μm) was used in place of obsidian. A casting was produced in the same manner as in Example 1 except that this hollow core was used, the cast material was SC-460, and the casting temperature was 1550° C.

Example 3

A hollow core of 1.2 mm in thickness weighing 7 g was obtained in the same manner as in Example 1 except that the following carbon fiber was used as the inorganic fiber. A casting was produced in the same manner as in Example 1 except that this hollow core was used.

Carbon fiber: Pitch-based carbon fiber (Kureka Chop T-106, fiber length 4 mm, shrinkage degree 1.5%, manufactured by Kureha Chemical Industry Co., Ltd.)

Example 4

A hollow core of 1.2 mm in thickness weighing 7 g was obtained in the same manner as in Example 1 except that commercial phenol-resol resin (actual carbon ratio, 35%) was used as the thermosetting resin. A casting was produced in the same manner as in Example 1 except that this hollow core was used.

Example 5

A main mold having a cavity corresponding to the tubular casting 10 shown in FIG. 2 was formed in the same manner as in Example 1, to give a main mold of 1.2 mm weighing 9 g. Using the main mold, a casting was produced in the same manner as in Example 1.

Example 6

The hollow core in Example 1 was thermally treated at 200° C. for 1 hour in a nitrogen atmosphere, and then a casting was produced in the same manner as in Example 1.

Example 7

A hollow core of 1.2 mm weighing 7 g was obtained in the same manner as in Example 6 except that flaky graphite-185 (average particle diameter 80 μm, purchased from Fuji Kozai Co., Ltd.) was used as the inorganic particles, o-cresol novolak epoxy resin/novolak phenol resin was used as the thermosetting resin, and the composition shown in Table 1 was used. A casting was produced in the same manner as in Example 1 except that this hollow core was used, the casting material was FCD-600 and the casting temperature was 1380° C.

Comparative Example 1

A casting was produced in the same manner as in Example 1 except that the material composition of the structure for producing castings was changed into the composition shown in Table 1.

Comparative Example 2

A hollow core was obtained in the same manner as in Example 1 except that the material composition of the structure for producing castings was changed into the composition shown in Table 1. The resulting hollow core was impregnated with polyvinyl alcohol to give a hollow core of 1.2 mm in thickness weighing 7 g. Using this hollow core, a casting was produced in the same manner as in Example 1.

Comparative Example 3

Using shell sand with flattery sand as original sand, a hollow core (weight of about 200 g) in the same shape as in Example 1 was prepared, and a casting was prepared in the same manner as in Example 1.

TABLE 1

| | | Composition of structure (parts by weight) | | | | Refractoriness of inorganic | Weight of | | Surface roughness |
|---|---|---|---|---|---|---|---|---|---|
| | | Organic fiber | Inorganic fiber | Inorganic particle | Thermosetting resin | particles (° C.) | structure (g) | Moldability of structure | Ra(μm) of structure |
| Example | 1 | 25 | 10 | 45 | 20 | 1200 | 7 | ○ | 8.2 |
| | 2 | 25 | 10 | 45 | 20 | 1700 | 7 | ○ | 6.5 |
| | 3 | 25 | 10 | 45 | 20 | 1200 | 7 | ○ | 8.1 |
| | 4 | 25 | 10 | 45 | 20 | 1200 | 7 | ○ | 16.0 |
| | 5 | 25 | 10 | 45 | 20 | 1200 | 9 | ○ | 7.8 |
| | 6 | 25 | 10 | 45 | 20 | 1200 | 7 | ○ | 7.5 |
| | 7 | 25 | 5 | 50 | 20 | 3300 | 7 | ○ | 7.6 |
| Comparative example | 1 | 20 | 30 | 0 | 50 | — | 7 | ○ | 27.0 |
| | 2 | 25 | 10 | 45 | 0 | 1200 | 7 | ○ | 23.5 |
| | 3 | | | shell sand | | — | 200 | ○ | 17.1 |

| | | Amount of resin insolubles (%) | Casting materials/carbon equivalent (° C.) | Casting temperature (° C.) | Shape retention of casting | Surface roughness Ra(μm) of casting | Removability of structure after casting |
|---|---|---|---|---|---|---|---|
| Example | 1 | 48 | FC-300/ 3.7 | 1380 | ○ | ○ 7.5 | ○ |
| | 2 | 56 | SC-460/ 0.35 | 1550 | ○ | ○ 6.2 | ○ |
| | 3 | 39 | FC-300/ 3.7 | 1380 | Δ | ○ 7.5 | ○ |
| | 4 | 45 | FC-300/ 3.7 | 1380 | ○ | Δ 16 | ○ |
| | 5 | 52 | FC-300/ 3.7 | 1380 | ○ | ○ 7.0 | ○ |
| | 6 | 94 | FC-300/ 3.7 | 1380 | ◎ | ○ 7.0 | ○ |
| | 7 | 96 | FCD-600/ 4.3 | 1380 | ○ | ○ 8.0 | ○ |
| Comparative example | 1 | 95 | FC-300/ 3.7 | 1380 | X | Not measurable | ○ |
| | 2 | — | FC-300/ 3.7 | 1380 | X | X 50 or more | ○ |
| | 3 | 96 | FC-300/ 3.7 | 1380 | ○ | ○ 13 | X |

As shown in Table 1, the structures for producing moldings in Examples 1 to 7 were lightweight, were excellent in moldability, and were equal or superior to that in Comparative Example 3 in respect of the shape retention and surface smoothness, after casting, of the structure for producing castings. Any structures for producing castings in Examples 1 to 7 were excellent in removability after papermaking. In Comparative Example 1 wherein no inorganic particles were added, a structure for producing castings could be formed, but the resulting casting was inferior in shape retention and surface smoothness. In Comparative Example 2 wherein no thermosetting resin was used, a structure for producing castings could be produced, but was poor in hot strength, and thus the resulting casting was inferior in shape retention and surface smoothness.

Structures for producing castings, with the material compositions shown in Table 2, were prepared as shown in Examples 8 to 16 and Comparative Examples 4 and 6, and the resulting structures for producing castings were measured for their weight, surface roughness (Ra) and the amount of the insoluble of the thermosetting resin, and the moldability of the structures for producing castings was evaluated in the same manner as described above. The resulting structures for producing castings were used to produce castings, and the surface smoothness of the castings, and the removability, after casting, of the structures for producing castings were evaluated in the same manner as described above, and the inside diameter dimensional accuracy of the castings was evaluated in the following manner. The results are collectively shown in Table 2.

Examples 8 to 16

<Preparation of Starting Slurry>

Organic fibers, inorganic fibers and inorganic particles shown below were dispersed in water with a composition shown in Table 2 to prepare about 1 wt % slurry, and then thermosetting resin powder and a suitable amount of a flocculating agent shown below were added to the slurry to prepare starting slurry.

Organic fibers: Waste newspaper (average fiber length 1 mm, freeness (CSF) 150 cc)

Inorganic fibers: PAN-based carbon fiber (Toreka Chop, fiber length 3 mm, shrinkage degree 0.1%, manufactured by Toray)

Inorganic particles: Obsidian (Nice Catch, average particle diameter 30 μm, manufactured by KINSEI MATEC CO., LTD.)

Mineral particles: Mullite (refractoriness 1700° C., average particle diameter 30 μm), alumina (refractoriness 1775° C., average particle diameter 32 μm), and graphite (flaky graphite-185, average particle diameter 80 μm, purchased from Fuji Kozai Co., Ltd.), Thermosetting resin: Novolak phenol resin (SP1006LS, actual carbon ratio 38%, manufactured by Asahi Organic Chemicals Industry Co., Ltd.)

Flocculating agent: Polyacrylamide-based flocculating agent (A110, manufactured by Mitsui Scitec)

<Papermaking of the Structure>

A hollow core 1 of 1.2 mm in thickness in the form shown in FIG. 1 with the weight and composition shown in Table 2 was obtained by the same method as in Example 1 etc.

<Production of a Casting>

A main mold having a cavity corresponding to casting 10 in a tubular form as shown in FIG. 2 was produced from molding sand, and the above hollow core 1 of ϕ40×100 mm was arranged therein, and without filling molding sand in the core 1, a casting was produced from the casting materials and at the casting temperature shown in Table 2.

[Evaluation of the Inside Diameter Dimensional Accuracy of the Casting]

The casting 10 obtained by the casting method described above was arranged lengthwise on a mold platen, and the inside diameter of the cylinder hollow was measured at 3 positions (upper part, middle part, lower part) of the hollow by means of an inside diameter measuring instrument (LED dimensional measuring censor, manufactured by Keyence Corporation), and the inside diameter dimensional accuracy was evaluated in terms of a difference of the measured inside diameter from that of the corresponding circle (in this case, a circle of 40 mm in diameter). That is, when the hollow of the casting 10 is circular, the error of the inside diameter is 0, and the error nearer 0 is indicative of higher dimensional accuracy. The width between the maximum value and minimum value is shown in Table 2.

Comparative Example 4

A casting was produced in the same manner as in Example 8 except that the material composition of the structure was changed into the composition shown in Table 2.

Comparative Example 5

A hollow core was obtained in the same manner as in Example 8 except that the material composition of the structure was changed into the composition shown in Table 2. The resulting hollow core was impregnated with polyvinyl alcohol to give a hollow core of 1.2 mm in thickness weighing 7 g. Using this hollow core, a casting was produced in the same manner as in Example 8.

Comparative Example 6

Using shell sand with flattery sand as original sand, a hollow core (weight of about 200 g) in the same shape as in Example 8 was prepared., and a casting was produced in the same manner as in Example 8.

TABLE 2

| | | Structure (hollow core) | | | | | | | |
|---|---|---|---|---|---|---|---|---|---|
| | | Structure composition (parts by weight) | | | | | | | |
| | | | | Inorganic particle | | | | | Surface |
| | | | | | Mineral particles | | | | |
| | | Organic fiber | Inorganic fiber | Obsidian | kind/refractoriness | Parts by weight | Thermosetting resin | Weight (g) | roughness Ra(μm) |
| Example | 8 | 25 | 10 | 40.5 | Mullite/1700° C. | 4.5 | 20 | 7 | 7.0 |
| | 9 | 25 | 10 | 31.5 | Mullite/1700° C. | 13.5 | 20 | 7 | 6.0 |
| | 10 | 25 | 10 | 22.5 | Mullite/1700° C. | 22.5 | 20 | 7 | 6.1 |
| | 11 | 25 | 10 | 13.5 | Mullite/1700° C. | 31.5 | 20 | 7 | 6.4 |
| | 12 | 25 | 10 | 4.5 | Mullite/1700° C. | 40.5 | 20 | 9 | 7.3 |
| | 13 | 25 | 10 | 22.5 | Alumina/1775° C. | 22.5 | 20 | 7 | 5.7 |
| | 14 | 25 | 5 | 25 | Graphite/3300° C. | 25 | 20 | 7 | 8.0 |
| | 15 | 25 | 10 | 0 | Mullite/1700° C. | 45.0 | 20 | 7 | 8.2 |
| | 16 | 25 | 10 | 0 | Almina/1775° C. | 45.0 | 20 | 7 | 6.5 |
| Comparative example | 4 | 20 | 30 | 0 | — | 0 | 50 | 7 | 27.0 |
| | 5 | 25 | 10 | 45 | — | 0 | 0 | 7 | 23.5 |
| | 6 | | | | Shell sand | | | 200 | 17.1 |

| | | Structure (hollow core) Amount of resin insolubles (%) | Casting material/ carbon equivalent | Casting temperature (° C.) | Inside diameter dimension accuracy of casting | Surface roughness Ra(μm) of casting | Removability of structure after casting |
|---|---|---|---|---|---|---|---|
| Example | 8 | 48 | FC-300/3.7% | 1380 | −0.3~+0.7 | ○ 6.0 | ○ |
| | 9 | 56 | FC-300/3.7% | 1380 | −0.2~+0.5 | ○ 5.5 | ○ |
| | 10 | 39 | FC-300/3.7% | 1380 | −0.2~+0.3 | ○ 5.0 | ○ |
| | 11 | 45 | FC-300/3.7% | 1380 | −0.2~+0.4 | ○ 5.3 | ○ |
| | 12 | 52 | FC-300/3.7% | 1380 | −0.3~+0.6 | ○ 6.2 | ○ |
| | 13 | 94 | FC-300/3.7% | 1380 | −0.3~+0.7 | ○ 4.8 | ○ |
| | 14 | 95 | FC-300/3.7% | 1380 | −0.2~+0.2 | ○ 5.0 | ○ |
| | 15 | 48 | FC-300/3.7% | 1380 | −1.7~+1.8 | ○ 7.5 | ○ |

TABLE 2-continued

| | | | | | | | |
|---|---|---|---|---|---|---|---|
| | 16 | 56 | SC-460/0.35% | 1550 | −2.0~+1.8 | ○ 6.2 | ○ |
| Comparative example | 4 | 95 | FC-300/3.7% | 1380 | not measurable due to significant deformation | not measurable | ○ |
| | 5 | — | FC-300/3.7% | 1380 | not measurable due to significant deformation | X 50 or more | ○ |
| | 6 | 96 | FC-300/3.7% | 1380 | −0.3~+0.8 | ○ 13 | X |

As shown in Table 2, the hollow cores as the structures in Examples 8 to 14 were lightweight, were excellent in surface roughness and were equal or superior to that in Comparative Example 6 in respect of the dimensional accuracy and surface smoothness of the castings after production. Any hollow cores in Examples 8 to 14 were excellent in removability after papermaking. In Comparative Example 4 wherein no inorganic particles were added, a hollow core could be formed, but the resulting casting was inferior in shape retention and surface smoothness. In Comparative Example 5 wherein no thermosetting resin was used, a hollow core could be produced, but was poor in hot strength, and thus the resulting casting was inferior in shape retention and surface smoothness. When inorganic particles having obsidian and mineral particles combined therein as shown in Examples 8 to 14, the dimensional accuracy and surface roughness of the resulting castings were further improved as compared with Examples 1s and 16 where mineral particles only were used as the inorganic particles.

The invention claimed is:

1. A method of producing a structure for producing castings, which comprises an organic fiber in an amount of from 10 to 30 wt. %, an inorganic fiber in an amount of from 2 to 30 wt. %, inorganic particles in an amount of from 30 to 60 wt. %, and a thermosetting resin in an amount of from 5 to 40 wt. %, wherein the inorganic fiber is carbon fiber and the thermosetting resin is at least one thermosetting resin selected from the group consisting of phenol resin, epoxy resin and furan resin; and wherein the structure for producing castings has a surface roughness (Ra) of 3 to 20 μm and a thickness of 0.2 to 5 mm, which comprises:

depositing a starting slurry comprising at least the organic fiber, the inorganic fiber and the inorganic particles into a papermaking mold;

dewatering the slurry;

forming a fiber laminate;

transferring the laminate to a second mold; and molding the laminate.

2. The method according to claim 1, wherein the structure for producing castings is a core.

3. The method according to claim 2, wherein the core is hollow.

4. The method according to claim 1, which is a structure for producing castings from molten metal having a carbon equivalent of 4.2% or less.

5. The method according to claim 4, wherein the inorganic particles are inorganic particles having a refractoriness of 800 to 2000° C.

6. The method according to claim 1, wherein the organic fiber has an average fiber length of 0.3 to 2.0 mm and the carbon fiber has an average fiber length of 0.2 to 10.0 mm.

7. The method according to claim 1, wherein the organic fiber is paper fiber.

8. The method according to claim 1, wherein the the thermosetting resin is selected from the group consisting of phenol resin and furan resin.

9. The method according to claim 1, which has a surface roughness (Ra) of 3 to 15 μm.

10. The method according to claim 1, which has a thickness of 0.4 to 2 mm.

* * * * *